US011712912B2

(12) United States Patent
Watanabe et al.

(10) Patent No.: US 11,712,912 B2
(45) Date of Patent: Aug. 1, 2023

(54) PRINTING APPARATUS

(71) Applicant: BROTHER KOGYO KABUSHIKI KAISHA, Nagoya (JP)

(72) Inventors: Shotaro Watanabe, Nagoya (JP); Yushi Kato, Nagoya (JP); Sho Asai, Ama (JP); Yusuke Ikemoto, Nagoya (JP); Takehiko Inaba, Chita (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/562,900

(22) Filed: Dec. 27, 2021

(65) Prior Publication Data

US 2022/0203723 A1 Jun. 30, 2022

(30) Foreign Application Priority Data

Dec. 28, 2020 (JP) ..... 2020-219182

(51) Int. Cl.
*B41J 15/04* (2006.01)
*B41J 29/13* (2006.01)
*B41J 3/407* (2006.01)

(52) U.S. Cl.
CPC ..... *B41J 15/042* (2013.01); *B41J 3/4075* (2013.01); *B41J 29/13* (2013.01)

(58) Field of Classification Search
None
See application file for complete search history.

(56) References Cited

U.S. PATENT DOCUMENTS

2003/0002908 A1* 1/2003 Hirabayashi ..... B41J 11/706 400/649
2011/0203467 A1* 8/2011 Naito ..... B41J 3/4075 101/212
2013/0107281 A1* 5/2013 Maekawa ..... B41J 15/042 358/1.1
2019/0308428 A1 10/2019 Kanda et al.

FOREIGN PATENT DOCUMENTS

JP 5823011 B1 * 11/2015 ..... B41J 11/0095
JP 2019-181764 A 10/2019

* cited by examiner

*Primary Examiner* — Matthew G Marini
(74) *Attorney, Agent, or Firm* — Kenealy Vaidya LLP

(57) ABSTRACT

A printing apparatus includes: a print head; a main body having an accommodation part accommodating a printing medium; an opening/closing cover supported by the main body to be swingable between a closed position and an opened position, the opening/closing cover covering the accommodation part in a case the opening/closing cover is in the opened position, the opening/closing cover opening the accommodation part in a case the opening/closing cover is in the opened position; a support member provided to the opening/closing cover; and a platen holder provided to the support member and configured to rotatably support a platen roller, the platen roller being configured to convey the printing medium at a position facing the print head in the case the opening/closing cover is in the closed position.

15 Claims, 7 Drawing Sheets

PRINTING APPARATUS

CROSS-REFERENCE TO RELATED APPLICATIONS

This application is based on and claims priority under 35 USC 119 from Japanese Patent Application No. 2020-219182 filed on Dec. 28, 2020, the contents of which are incorporated herein by reference.

TECHNICAL FIELD

The present disclosure relates to a printing apparatus.

BACKGROUND

A related art discloses a printing apparatus configured to hold a roll having a printing medium rolled thereon, to reel out the printing medium from the roll and to perform printing. For example, disclosed is a printing apparatus where a platen holder configured to rotatably support a platen roller is provided at a front end portion of a cover configured to open and close. The platen holder is firmly fixed to the cover by a plurality of screws.

SUMMARY

One illustrative aspect of the present disclosure provides a printing apparatus. The printing apparatus includes: a print head configured to perform printing on a printing medium; a main body having an accommodation part accommodating the printing medium; an opening/closing cover supported by the main body so as to be swingable between a closed position and an opened position; a support member provided to the opening/closing cover; and a platen holder provided to the support member and configured to rotatably support a platen roller. The opening/closing cover covers the accommodation part in a case the opening/closing cover is in the opened position, and the opening/closing cover opens the accommodation part in a case the opening/closing cover is in the opened position. The platen roller is configured to convey the printing medium at a position facing the print head in the case the opening/closing cover is in the closed position.

The printing apparatus of the present disclosure includes the print head, the main body, the opening/closing cover, the support member, and the platen holder. The platen holder is configured to rotatably support the platen roller configured to convey the printing medium in the position that faces the print head when the opening/closing cover is located in the closed position. The opening/closing cover is configured to open/close the accommodation part in which the printing medium is accommodated. The support member is fixed to the opening/closing cover, and the platen holder is fixed to the support member.

According to the present disclosure, the platen holder is fixed to the opening/closing cover via the support member, not being directly fixed to the opening/closing cover. For example, when a high impact is applied to the platen roller such as a case where the printing apparatus drops by mistake, the impact is not directly transmitted from the platen holder to the opening/closing cover but is transmitted from the platen holder to the opening/closing cover via the support member. According to the present disclosure, the member configured to fix the platen holder and the support member each other, the support member, the member configured to fix the support member and the opening/closing cover each other, and the like are each deformed, so that the dropping impact is dispersed and the damage can be thus prevented.

According to the present disclosure, when the high impact is applied to the platen roller such as a case where the printing apparatus drops, the dropping impact is dispersed and the damage can be thus prevented.

BRIEF DESCRIPTION OF THE DRAWINGS

Illustrative embodiments of the disclosure will be described in detail based on the following figures, wherein.

DETAILED DESCRIPTION

When the related-art printing apparatus drops in a state where the cover is closed, a load may be applied to the platen roller due to a dropping impact. Here, since the platen holder and the cover are directly fixed, the dropping impact is not dispersed, so that a screw fastening portion and the like of the platen holder may be damaged. This may also be caused when an impact other than the dropping is applied, for example, when something hits.

Therefore, illustrative aspects of the present disclosure provide a printing apparatus which would reduce a damage when a high impact is applied due to dropping of the printing apparatus, for example.

Hereinafter, an illustrative embodiment of the present disclosure will be described with reference to the drawings. A printing apparatus 1 is connected to an external terminal (not shown) via a signal cable. The printing apparatus 1 is configured to print characters such as letters, figures and the like on a printing medium, based on print data received from the external terminal. The external terminal is, for example, a general-purpose personal computer (PC). The printing apparatus 1 can be driven by a battery. The printing apparatus 1 is carried and used by a user during an operation by being mounted to a waist belt via a belt clip (not shown), for example. The right lower side, the left upper side, the right upper side, the left lower side, the upper side and the lower side in FIG. 1 are each defined as the right side, the left side, the rear side, the front side, the upper side and the lower side of the printing apparatus 1.

1. Overall Configuration of Printing Apparatus

Figure 1:
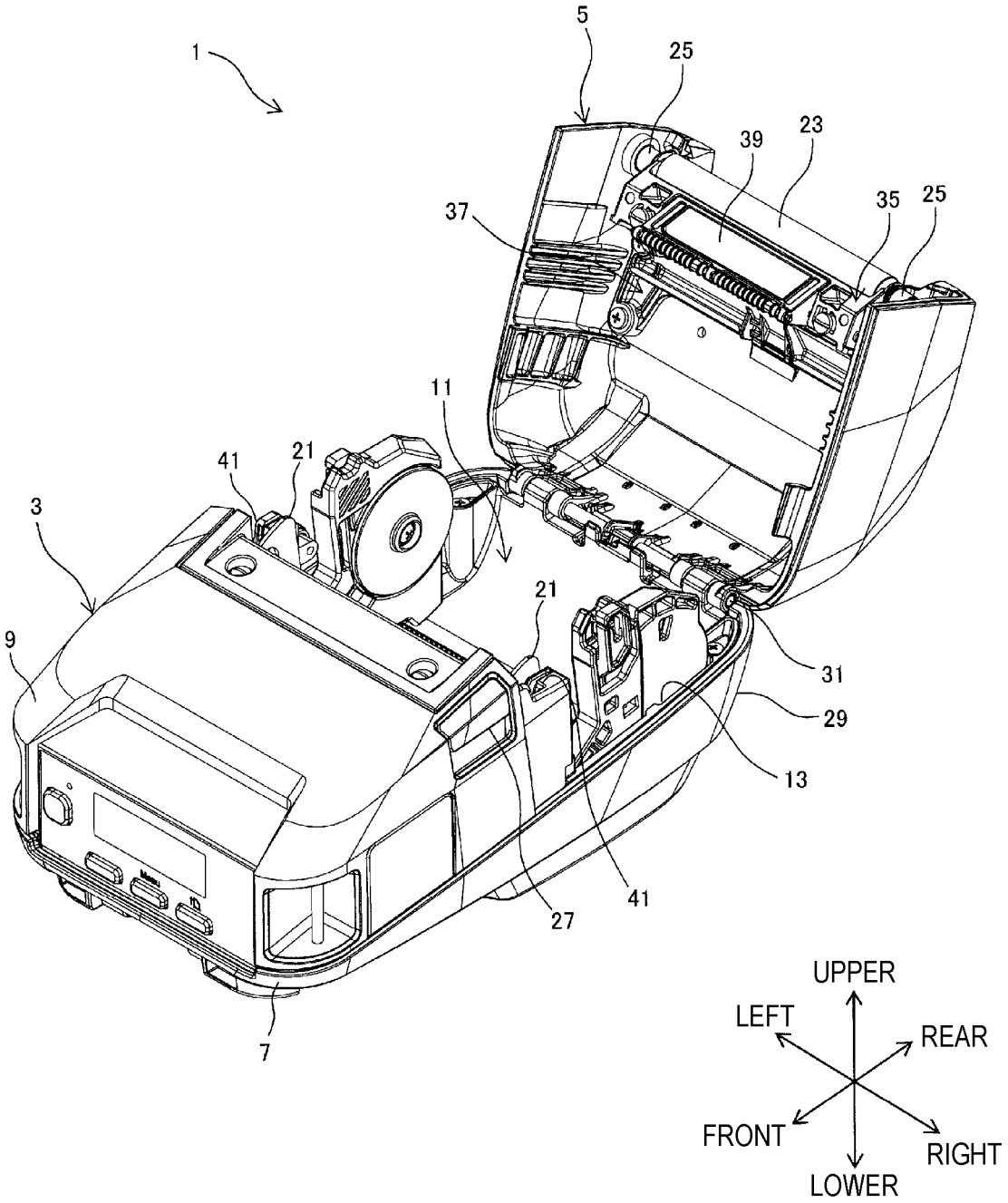
FIG. 1 is a perspective view showing an overall configuration of a printing apparatus in a state where an opening/closing cover is opened, as seen from the upper right front.
Figure 2:
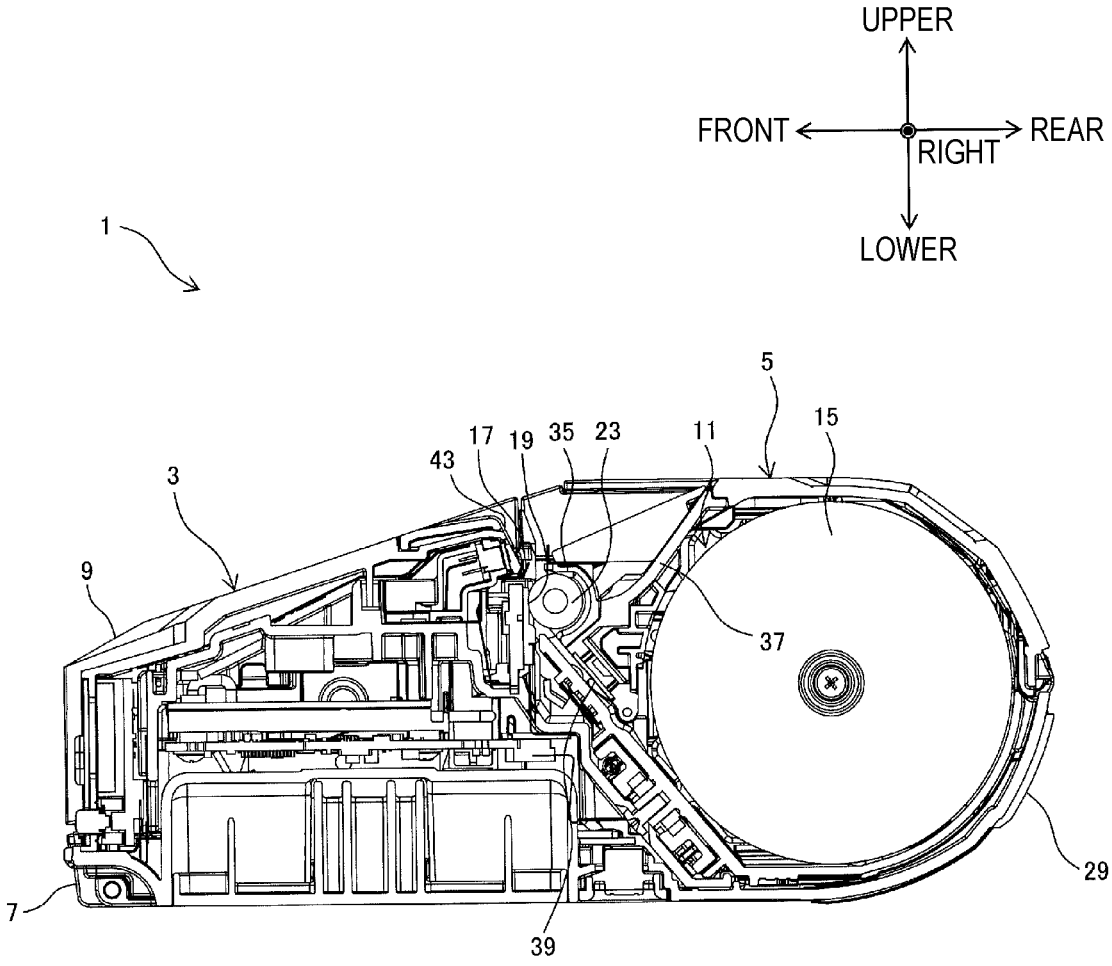
FIG. 2 is a sectional view showing a sectional configuration of the printing apparatus in a state where the opening/closing cover is closed.

FIG. 1 shows an overall configuration of the printing apparatus in a state where an opening/closing cover is opened. FIG. 2 shows a sectional configuration of the printing apparatus in a state where the opening/closing cover is closed. As shown in FIGS. 1 and 2, the printing apparatus 1 has a main body 3 and an opening/closing cover 5. The main body 3 and the opening/closing cover 5 are formed, for example, by a synthetic resin. The main body 3 has a substantially cuboid shape, and has a bottom part 7 and a front-side covering part 9. The bottom part 7 is configured to cover an internal area of the printing apparatus 1 from the lower side. The front-side covering part 9 is configured to cover a substantial front-side half of the internal area of the printing apparatus 1 from the upper side. An accommodation part 11 is provided at a substantial rear-side half part of the bottom part 7. As shown in FIG. 1, an upper side of the accommodation part 11 is opened by an opening part 13 formed at the main body 3.

As shown in FIG. 2, a roll 15 is accommodated in the accommodation part 11. The roll 15 is configured by rolling a tape, which is a long mount on which a plurality of heat-sensitive labels is discretely pasted, on a cylindrical core. The tape is an example of the printing medium. A front end portion of the opening part 13 of the main body 3 is provided with a cutting blade 17. The cutting blade 17 is configured to cut a printed part of the tape. A thermal head 19 is provided below the cutting blade 17. The thermal head 19 is configured to print a character on the heat-sensitive label by heating. The thermal head 19 is an example of the print head. The cutting blade 17 and the thermal head 19 each extend in the right and left direction.

As shown in FIG. 1, both left and right end portions of the opening part 13 of the main body 3 are provided with locking portions 21. A lower end portion of each locking portion 21 is supported so that an upper end portion can swing. Although described in detail later, the opening/closing cover 5 is provided with a platen holder 35 configured to rotatably support a platen roller 23. When the opening/closing cover 5 is located in a closed position (refer to FIG. 2), the locking portions 21 are each locked to bearings 25 provided at both ends of the platen roller 23 of the opening/closing cover 5. When a lever 27 provided on a right side surface of the main body 3 is pushed down by the user, the upper end portion of each locking portion 21 swings rearward to release the locking to the bearing 25.

As shown in FIG. 1, the opening/closing cover 5 is supported to the main body 3 to be swingable between the closed position and an opened position by a support shaft 31 extending in the right and left direction and provided at an upper end portion of a rear wall 29 of the main body 3. The opening/closing cover 5 covers the upper side of the accommodation part 11 when located in the closed position (refer to FIG. 2). The opening/closing cover 5 opens the accommodation part 11 when located in the opened position (refer to FIG. 1). The opening/closing cover 5 is urged in a swinging direction from the closed position toward the opened position by an urging member (not shown). In the below, each direction of the printing apparatus 1 is applied to the opening/closing cover 5, based on the opening/closing cover 5 (refer to FIG. 0.2) located in the closed position.

As shown in FIGS. 1 and 2, the platen holder 35 is disposed at a front end portion of the opening/closing cover 5. The platen holder 35 is configured to rotatably support the platen roller 23. The platen roller 23 is configured to convey the tape in a position that faces the thermal head 19 at a time when the opening/closing cover 5 is located in the closed position. A rotary shaft of the platen roller 23 extends in the right and left direction. The rotary shaft of the platen roller 23 is rotatably supported by the cylindrical bearings 25 disposed on outer sides in the right and left direction of both end portions of the platen roller 23. The bearing 25 is held by the platen holder 35.

The platen holder 35 is provided at a sensor holder 37. The sensor holder 37 is provided on a front side of the opening/closing cover 5. Specifically, the platen holder 35 is provided at the opening/closing cover 5 via the sensor holder 37. The sensor holder 37 is configured to support a sensor 39 configured to detect presence or absence of the tape that is conveyed by the platen roller 23. The sensor 39 is, for example, an optical reflection sensor. The sensor holder 37 is an example of the support member.

As shown in FIG. 1, each concave portion 41 of the main body 3 is configured to receive the corresponding bearing 25 from the lower side at a time when the opening/closing cover 5 is located in the closed position. Each locking portion 21 is locked to the corresponding bearing 25 from the upper side at a time when the opening/closing cover 5 is located in the closed position. Thereby, the opening/closing cover 5 is held in the closed position. When the lever 27 is pushed down in the state where the opening/closing cover 5 is in the closed position, each locking portion 21 separates from the corresponding bearing 25. The opening/closing cover 5 swings from the closed position (refer to FIG. 2) to the opened position (refer to FIG. 1) by an urging force of the urging member.

As shown in FIG. 2, the thermal head 19 and the platen roller 23 comes close to each other when the opening/closing cover 5 is in the closed position. In a case where the tape is disposed between the platen roller 23 and the thermal head 19, the platen roller 23 presses the tape toward the thermal head 19. The platen roller 23 is rotated by drive of a motor (not shown), thereby conveying the tape while pressing the tape against the thermal head 19. The tape printed by the thermal head 19 is discharged to an outside through a discharge port 43.

2. Fixing Structure of Platen Holder and Sensor Holder

Figure 3:
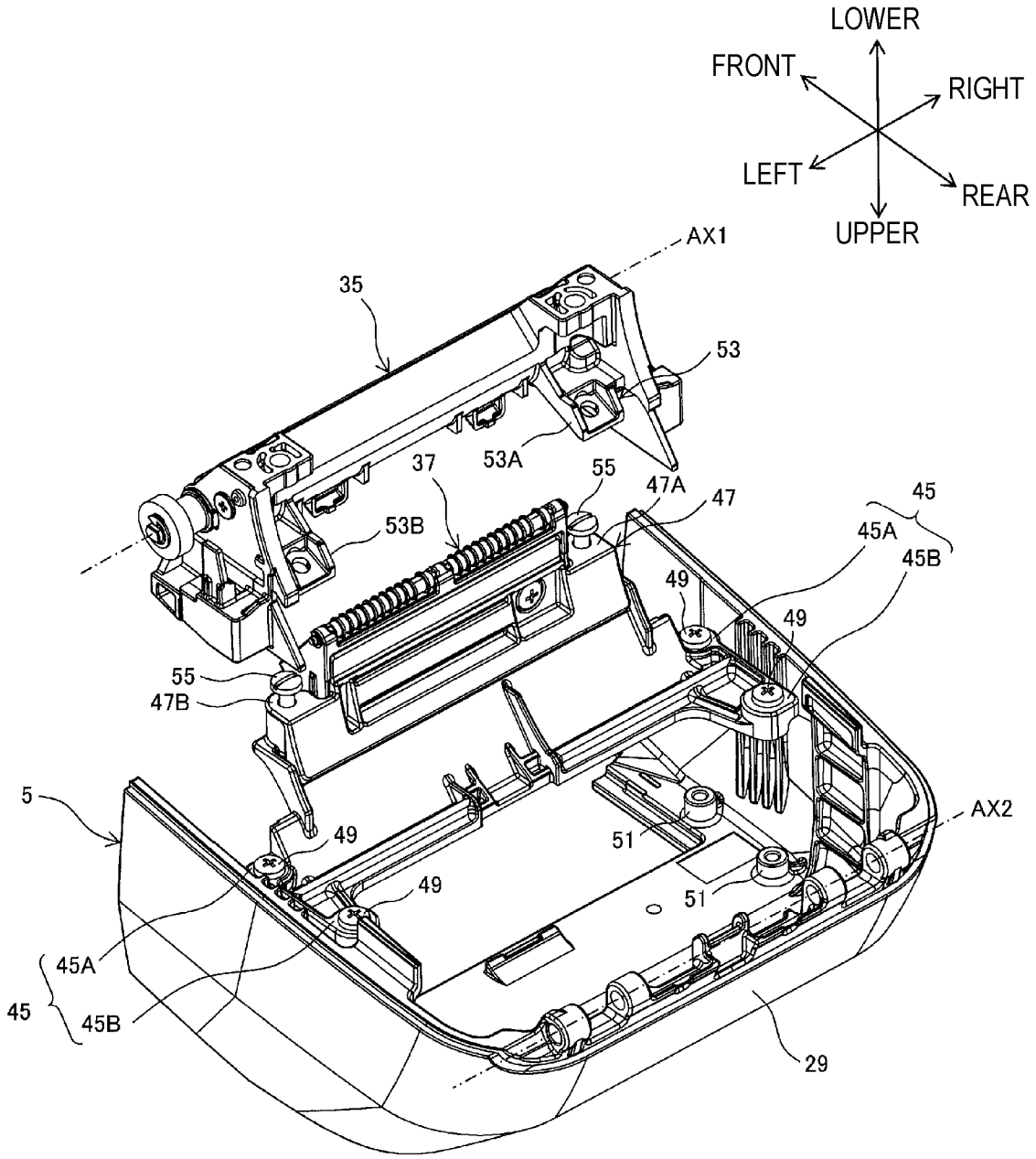
FIG. 3 is an exploded perspective view showing a fixing structure of a platen holder and a sensor holder to the opening/closing cover, as seen from the lower left rear.
Figure 4:
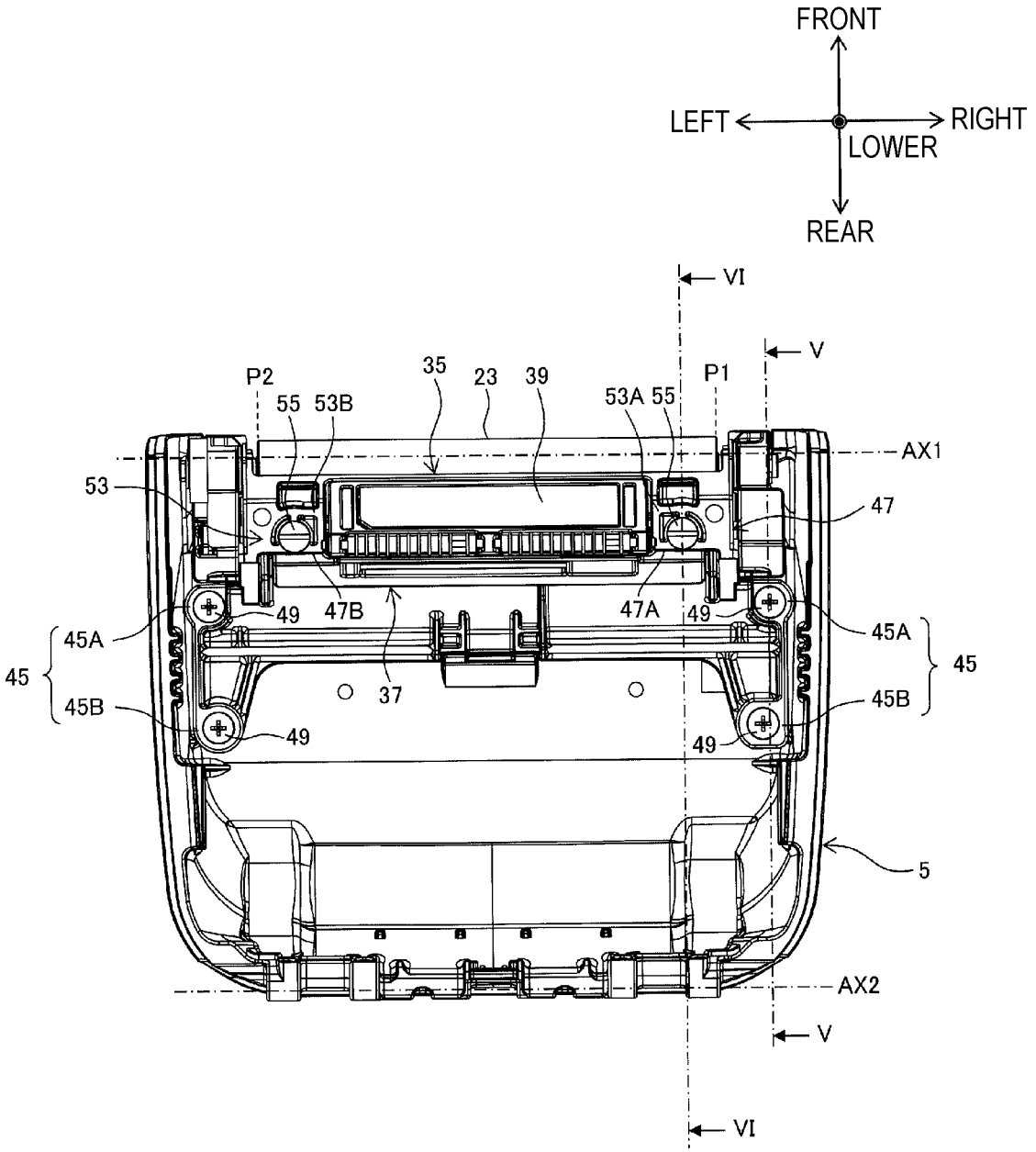
FIG. 4 is a bottom view showing a configuration on an inner side of the opening/closing cover.
Figure 5:
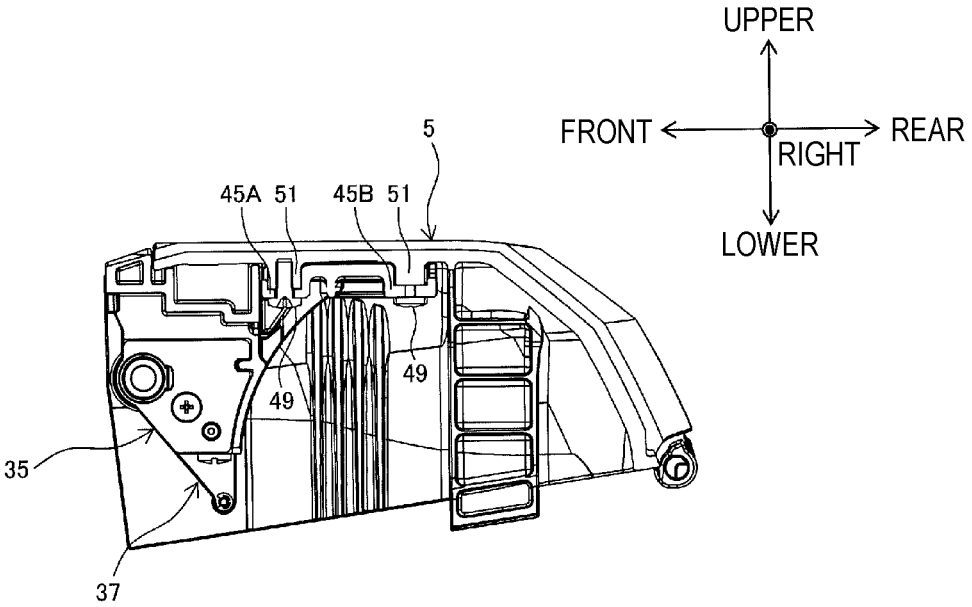
FIG. 5 is a sectional view taken along a line V-V in FIG. 4.
Figure 6:
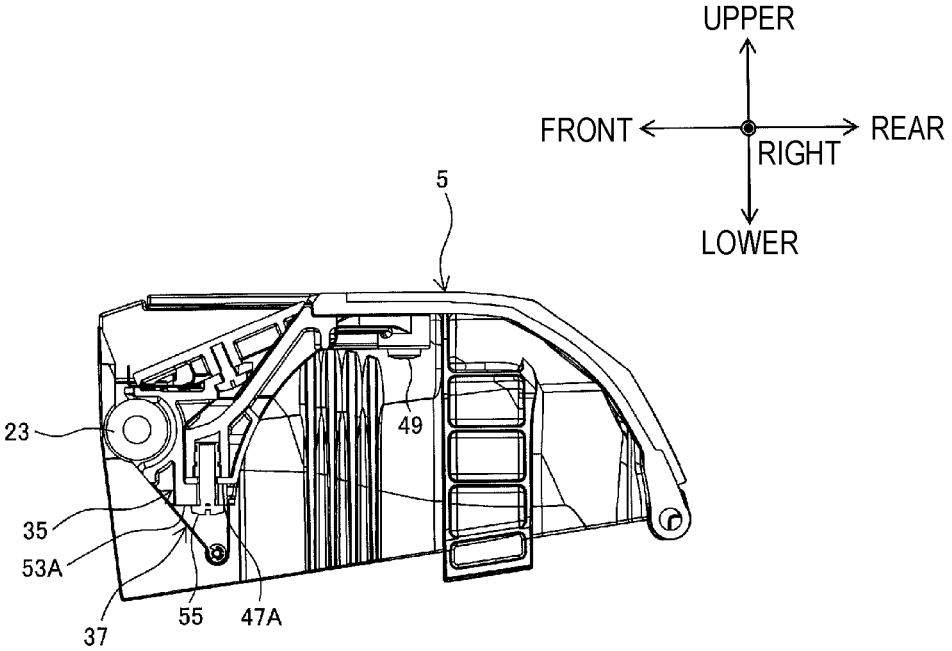
FIG. 6 is a sectional view taken along an VI-VI line in FIG. 4.

FIG. 3 shows a fixing structure of the platen holder 35 and the sensor holder 37 to the opening/closing cover 5. FIGS. 4 to 6 show a configuration on an inner side of the opening/closing cover 5. In FIGS. 3 to 6, each direction of the printing apparatus 1 is applied to the opening/closing cover 5, based on the opening/closing cover 5 (refer to FIG. 2) located in the closed position.

As shown in FIGS. 3 and 4, the sensor holder 37 has a base part 45 and a receipt part 47. Each base part 45 is provided on a respective side in the right and left direction parallel to a direction of a shaft center AX1 of the platen roller 23 above the sensor holder 37. The right and left direction is an example of the first direction. Each base part 45 has a first base part 45A provided on a front side in the front and rear direction orthogonal to the right and left direction, and a second base part 45B provided on a rear side in the front and rear direction. The front and rear direction is an example of the second direction, the front side is an example of one side in the second direction, and the rear side is an example of the other side in the second direction. As shown in FIGS. 3 and 5, the first base part 45A and the second base part 45B are fixed to bosses 51 of the opening/closing cover 5 by screws 49.

As shown in FIGS. 3 and 4, the platen holder 35 is attached and fixed to the receipt part 47. The receipt part 47 extends forward and downward at a center of the sensor holder 37 in the right and left direction. The receipt part 47 has a first receipt part 47A and a second receipt part 47B on both sides in the right and left direction. The first receipt part 47A and the second receipt part 47B are provided with the sensor 39 being interposed therebetween in the right and left direction.

The platen holder 35 has an attachment part 53 that is attached and fixed to the receipt part 47 of the sensor holder 37. The attachment part 53 has a first attachment part 53A and a second attachment part 53B on both sides in the right and left direction. As shown in FIGS. 3 and 6, the first attachment part 53A is fixed to the first receipt part 47A by a screw 55, and the second attachment part 53B is fixed to the second receipt part 47B by a screw 55.

As shown in FIG. 4, the receipt part 47 of the sensor holder 37 is provided in a position more distant from a shaft center AX2 of the support shaft 31 than the base part 45 in the front and rear direction. The platen holder 35 is configured to support the platen roller 23 in a position more distant from the shaft center AX2 of the support shaft 31 than the attachment part 53.

As shown in FIG. 4, positions in the right and left direction of the base parts 45 on both left and right sides are located on outermore sides in the right and left direction than positions P1 and P2 in the right and left direction of corresponding end portions of the platen roller 23. Positions in the right and left direction of the first receipt part 47A and the sensor receipt part 47B on both sides of the sensor holder 37 are located on more inner sides in the right and left direction than the positions P1 and P2 in the right and left direction of the corresponding end portions of the platen roller 23. Positions in the right and left direction of the first attachment part 53A and the second attachment part 53B on both sides of the platen holder 35 are located on more inner sides in the right and left direction than the positions P1 and P2 in the right and left direction of the corresponding end portions of the platen roller 23.

3. Advantages of Illustrative Embodiment

The printing apparatus 1 of the illustrative embodiment as described above includes the thermal head 19, the main body 3, the opening/closing cover 5, the sensor holder 37 and the platen holder 35. The platen roller 35 is configured to rotatably support the platen roller 23 configured to convey the tape in the position that faces the thermal head 19 at a time when the opening/closing cover 5 is located in the closed position. The opening/closing cover 5 opens and closes the accommodation part 11 in which the tape is accommodated. The sensor holder 37 is fixed to the opening/closing cover 5, and the platen holder 35 is fixed to the sensor holder 37.

According to the present illustrative embodiment, the platen holder 35 is fixed to the opening/closing cover 5 via the sensor holder 37, not being directly fixed to the opening/closing cover 5. For example, when a high impact is applied to the platen roller 23 such as a case where the printing apparatus 1 drops by mistake, the impact is not directly transmitted from the platen holder 35 to the opening/closing cover 5 but is transmitted from the platen holder 35 to the opening/closing cover 5 via the sensor holder 37. According to the present illustrative embodiment, the platen holder 35, the sensor holder 37 and the like are each deformed, so that the dropping impact applied to the platen roller 23 can be dispersed and the damage can be thus prevented.

Further, in the present illustrative embodiment, particularly, the sensor holder 37 includes the base parts 45 and the receipt part 47. The sensor holder 37 is fixed to the opening/closing cover 5 at the base parts 45. The platen holder 35 is attached and fixed to the receipt part 47 of the sensor holder 37. The receipt part 47 is provided in the position more distant from the support shaft 31 than the base parts 45. For this reason, there is a certain distance between the receipt part 47 and the base part 45 in the sensor holder 37. According to the present illustrative embodiment, as described above, when transmitting the impact transmitted from the platen holder 35 to the receipt part 47 to the opening/closing cover 5 via the base parts 45, the sensor holder 37 itself can be deformed to some extent due to the distance, so that the dropping impact can be easily dispersed.

Further, in the present illustrative embodiment, particularly, the platen holder 35 has the attachment part 53. The platen holder 35 is attached and fixed to the receipt part 47 of the sensor holder 37 at the attachment part 53. A support part of the platen holder 35 for the platen roller 23 is provided in a position more distant from the support shaft 31 than the attachment part 53. For this reason, there is a certain distance between the support part and the attachment part 53 in the platen holder 35. According to the present illustrative embodiment, as described above, when receiving the impact applied to the platen roller 23 at the support part of the platen holder 35 and transmitting the impact to the receipt part 47 of the sensor holder 37 via the attachment part 53, the platen holder 35 itself can be deformed to some extent due to the distance, so that the dropping impact can be easily dispersed.

Further, in the present illustrative embodiment, particularly, the base parts 45 of the sensor holder 37 each provided on each of both sides in the right and left direction are positioned on the outermore sides in the right and left direction than the positions P1 and P2 of both end portions of the platen roller 23. According to the present illustrative embodiment, as compared to a configuration where the positions in the right and left direction of both end portions of the platen roller 23 and the base parts 45 are the same, it is possible to lengthen a path at a time of transmitting the impact applied to the platen roller 23 to the opening/closing cover 5 via the sensor holder 37, so that the dropping impact can be dispersed.

Further, in the present illustrative embodiment, particularly, the first receipt part 47A and the second receipt part 47B of the sensor holder 37 each provided on each of both sides in the right and left direction are positioned on the more inner sides in the right and left direction than the positions P1 and P2 of both end portions of the platen roller 23. According to the present illustrative embodiment, as compared to a configuration where the positions in the right and left direction of both end portions of the platen roller 23 and the receipt parts 47A and 47B are the same, it is possible to lengthen a path at a time of transmitting the impact applied to the platen roller 23 to the sensor holder 37 via the platen holder 35, so that the dropping impact can be dispersed.

Further, in the present illustrative embodiment, particularly, the first attachment part 53A and the second attachment part 53B of the platen holder 35 each provided on each of both sides in the right and left direction are positioned on the more inner sides in the right and left direction than the positions P1 and P2 of both end portions of the platen roller 23. According to the present illustrative embodiment, as compared to a configuration where the positions in the right and left direction of both end portions of the platen roller 23 and the attachment parts 53A and 53B are the same, it is possible to lengthen a path at a time of transmitting the impact applied to the platen roller 23 to the sensor holder 37 via the platen holder 35, so that the dropping impact can be dispersed.

Further, in the present illustrative embodiment, particularly, the first base part 45A on the front side and the second base part 45B on the rear side in the front and rear direction are provided as the base part 45 of the sensor holder 37. According to the present illustrative embodiment, since the impact transmitted from the platen holder 35 can be transmitted to the opening/closing cover 5 while dividing the impact into both sides in the front and rear direction at the first base part 45A and the second base part 45B, the impact can be stably dispersed.

4. Modifications to Illustrative Embodiments

Note that, the present disclosure is not limited to the above illustrative embodiment, and can be diversely changed without departing from the scope of the present disclosure.

As described above, the tape that is a long mount on which the plurality of heat-sensitive labels is discretely pasted is used as the printing medium of the printing apparatus 1. In correspondence to this, a peeler mechanism configured to peel off the heat-sensitive label from the mount of the tape may be used as an option. The present modified illustrative embodiment is an example where the peeler mechanism is used.

Figure 7:
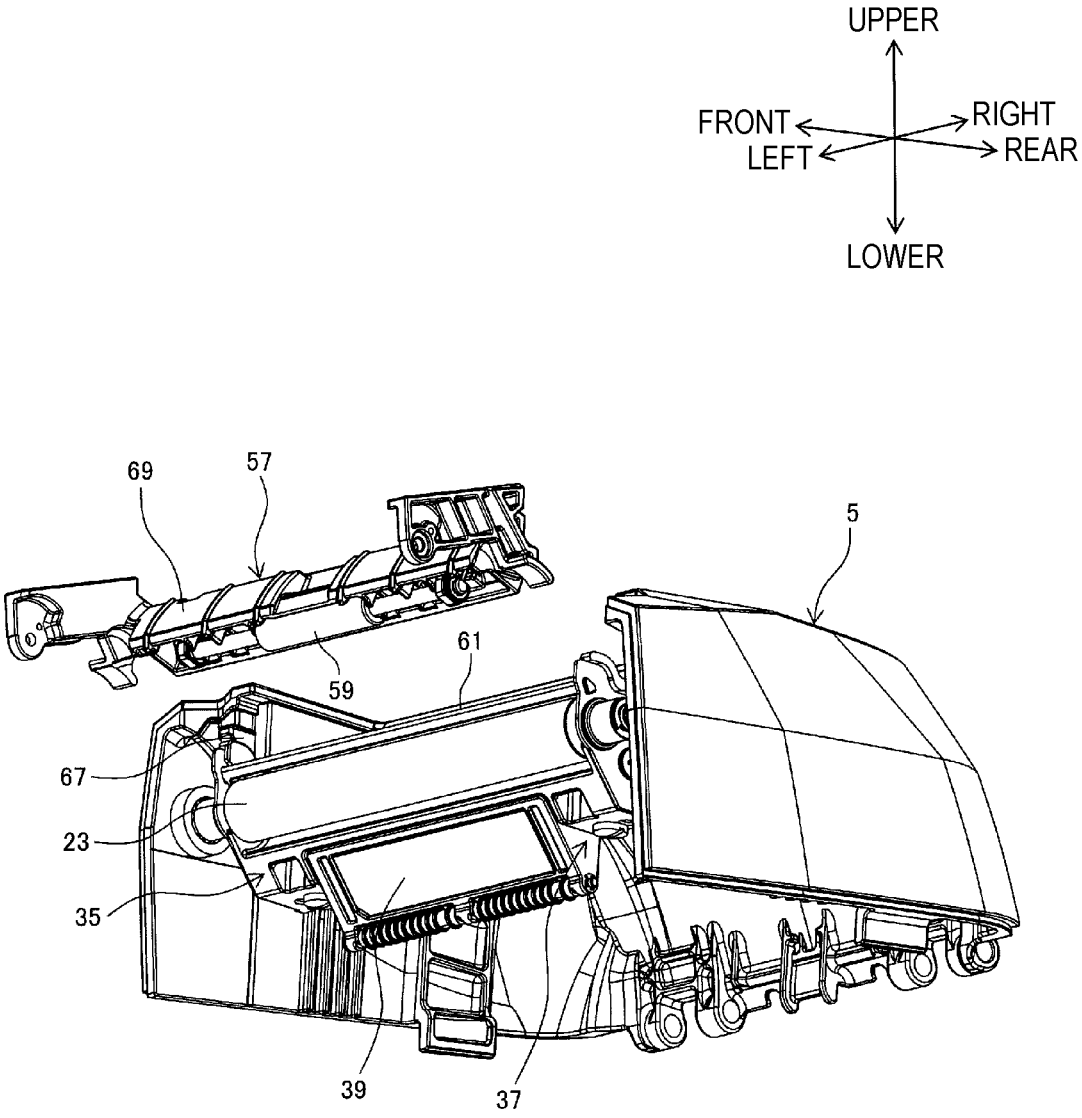
FIG. 7 is a perspective view showing a peeler mechanism, as seen from the lower right front.
Figure 8:
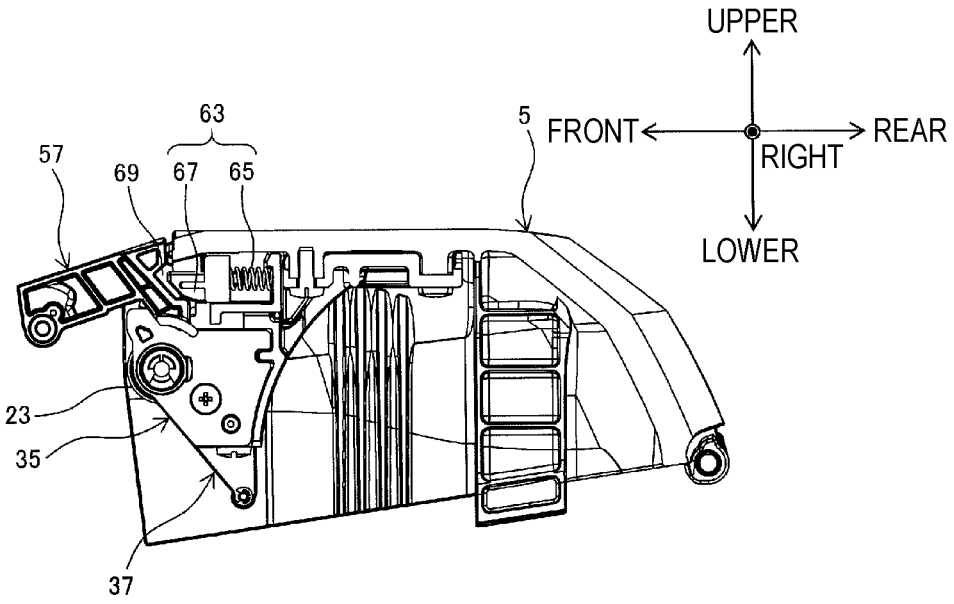
FIG. 8 is a sectional view showing a configuration on the inner side of the opening/closing cover in a state where the peeler mechanism is attached.
Figure 9:
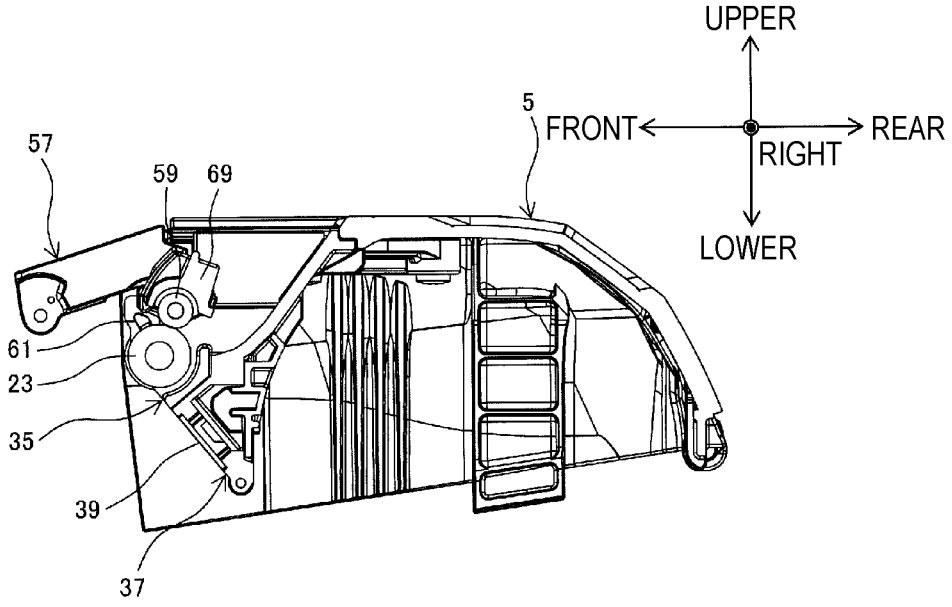
FIG. 9 is a sectional view showing the configuration on the inner side of the opening/closing cover in the state where the peeler mechanism is attached.

FIG. 7 shows a configuration of a peeler mechanism 57 before being attached to the main body 3. FIGS. 8 and 9 show a configuration on an inner side of the opening/closing cover 5 in a state where the peeler mechanism 57 is attached to the main body 3. In FIGS. 7 to 9, each direction of the printing apparatus 1 is applied to the opening/closing cover 5, based on the opening/closing cover 5 (refer to FIG. 2) located in the closed position. Note that, in FIGS. 7 to 9, the main body 3 is not shown.

As shown in FIGS. 7 to 9, the peeler mechanism 57 is attached to a rear end of the upper surface of the main body 3 in a position that faces the front end portion and the upper end portion of the opening/closing cover 5 located in the closed position. As shown in FIGS. 7 and 9, the peeler mechanism 57 includes a peeler roller 59, and a holding member 69 configured to rotatably hold the peeler roller 59. The peeler roller 59 extends in the right and left direction. The platen holder 35 has a bending part 61. The bending part 61 has an elongated rod shape, and extends in the right and left direction in parallel to the platen roller 23. As shown in FIG. 9, the peeler roller 59 is pressed against the platen roller 23 in the state where the opening/closing cover 5 is located in the closed position. The mount of the tape that is conveyed by the platen roller 23 is bent by the bending part 61 and is sandwiched by the peeler roller 59 and the platen roller 23. When the platen roller 23 rotates, the mount is conveyed and the peeler roller 59 also rotates, so that the mount is discharged. The heat-sensitive label pasted to the mount is conveyed without being bent by the bending part 61 due to the rigidity thereof. That is, the heat-sensitive label is peeled off from the mount and is discharged.

As shown in FIGS. 7 and 8, the platen holder 35 has a positioning part 63. The positioning part 63 is provided in a position above the left end of the platen roller 23. The positioning part 63 has an urging member 65 and a pressing member 67. The pressing member 67 is urged forward by the urging member 65 and is thus contacted to the holding member 69 configured to hold the peeler roller 59. A contact surface of the pressing member 67 is a front-side surface of the pressing member 67 and is inclined upward toward the front, as seen from a side. A contact surface of the holding member 68 is inclined by substantially the same angle as the inclination angle of the front-side surface of the pressing member 67. Both of the contact surfaces are located above the platen roller 23. Since the pressing member 67 is urged forward by the urging member 65, the holding member 69 is pressed downward by the inclination angles of both of the contact surfaces. The positioning part 63 is configured to hold a relative position of the peeler roller 59 to the platen roller 23 in a predetermined position. The positioning part 63 is configured to press the peeler roller 59 against the platen roller 23 by a constant pressing force. By the positioning part 63, the mount sandwiched by the platen roller 23 and the peeler roller 59 can be stably conveyed and discharged.

As described above, when the impact is applied to the platen roller 23, the platen holder 35 is deformed, so that the impact is dispersed. According to the present modified illustrative embodiment, even when the platen holder 35 is deformed as described above, since the platen holder 35 is provided with the positioning part 63 and the platen roller 23, the relative position relationship between the peeler roller 59 and the platen roller 23 does not change. As a result, even after the platen holder 35 is deformed, the peeler roller 59 can apply the same pressing force to the platen roller 23 as before the deformation.

Note that, the platen holder 35 may be deformed not only when the dropping occurs as described above but also when the user operates the opening/closing cover 5 with a force higher than necessary. Also in this case, similar to the above, even after the platen holder 35 is deformed, the relative position relationship between the peeler roller 59 and the platen roller 23 does not change, and the peeler roller 59 can apply the same pressing force to the platen roller 23 as before the deformation. As a result, as usual, the printing processing on the tape and the peeling processing of the heat-sensitive label from the mount of the tape after the printing can be executed.

Note that, in the above descriptions, when the terms 'vertical', 'parallel', and 'plane' are used, these terms may not necessarily mean 'vertical', 'parallel', and 'plane', respectively, in a strict sense. Specifically, the terms 'vertical', 'parallel', and 'plane' mean 'substantially vertical', 'substantially parallel', and 'substantial plane', respectively, with design-related and production-related tolerance and error taken into consideration.

Note that, in the above descriptions, when the terms 'same', 'equivalent', and 'different' are used in the context of dimensions or sizes of external appearance, these terms may not necessarily mean 'same', 'equivalent', and 'different', respectively, in a strict sense. Specifically, the terms 'same', 'equivalent', and 'different' mean 'substantially same', 'substantially equivalent', and 'substantially different', respectively, with design-related and production-related tolerance and error taken into consideration.

Also, other than mentioned above, the above illustrative embodiment and methods of each of the modified illustrative embodiments may be combined for use as appropriate.

Although not specifically exemplified, the present invention is put into practice with various changes made within a range not departing from the scope of the present invention.

What is claimed is:

1. A printing apparatus comprising:

a print head configured to perform printing on a printing medium;

a main body having an accommodation part accommodating the printing medium;

an opening/closing cover supported by the main body so as to be swingable between a closed position and an opened position, the opening/closing cover covering the accommodation part in a case the opening/closing cover is in the closed position, the opening/closing cover opening the accommodation part in a case the opening/closing cover is in the opened position;

a support member provided to the opening/closing cover; and a platen holder fixed to the support member and configured to rotatably support a platen roller, the platen roller being configured to convey the printing medium at a position facing the print head in the case the opening/closing cover is in the closed position, wherein the opening/closing cover is pivotally supported by the main body so as to be swingable by a support shaft, wherein the support member includes:

a base part fixed to the opening/closing cover at a first position, and a receipt part to which the platen holder is attached and fixed, wherein the receipt part is provided in a position more distant from the support shaft than the base part, wherein the platen holder includes an attachment part attached and fixed to the receipt part of the support member at a second position, wherein the platen holder is configured to support the platen roller at a third position, the third position being more distant from the support shaft than the attachment part in a second direction orthogonal to a first direction, the first direction being parallel to a shaft center direction of the platen roller, and wherein in the second direction, in a state in which the opening/closing cover is in the closed position, the third position is more distant from the support shaft than the second position, and the second position is more distant from the support shaft than the first position.

2. The printing apparatus according to claim 1, wherein the attachment part of the platen holder is attached and fixed to the receipt part of the support member by a first fastening member.

3. The printing apparatus according to claim 2, wherein the base part is fixed to the opening/closing cover by a second fastening member.

4. The printing apparatus according to claim 1, wherein the base part is provided on a respective side of the support member in the first direction, and wherein each position of the base part on the respective side in the first direction is located on a more outer side in the first direction than a respective position of an end portion of the platen roller in the first direction.

5. The printing apparatus according to claim 4, wherein the receipt part is provided on a respective side of the support member in the first direction, and wherein each position of the receipt part on the respective side in the first direction is located on a more inner side in the first direction than the respective position of the end portion of the platen roller in the first direction.

6. The printing apparatus according to claim 4, wherein the attachment part is provided on a respective side of the platen holder in the first direction, and wherein each position of the attachment part on the respective side in the first direction is located on a more inner side in the first direction than the respective position of the end portion of the platen roller in the first direction.

7. The printing apparatus according to claim 4, wherein the base part of the support member includes:

a first base part provided on a first side of the support member in a second direction, the second direction being orthogonal to the first direction; and a second base part provided on a second side of the support member in the second direction, the second side being opposite to the first side.

8. The printing apparatus according to claim 1, further including:

a peeler mechanism for use of a printing medium having a plurality of labels discretely put on a mount having a long shape, the peeler mechanism including a peeler roller configured to peel off the label from the mount by cooperating with the platen roller, wherein the platen holder includes a positioning part configured to hold a relative position of the peeler roller to the platen roller in a predetermined position.

9. The printing apparatus according to claim 1, the receipt part of the support member is provided in a position more distance from the support shaft than the base part, and the support member is configured, in a case of receiving an impact transmitted from the platen holder to the receipt part via the base part, to be deformable due to a distance between the receipt part and the base part, so as to disperse the impact.

10. The printing apparatus according to claim 1, the platen holder is configured, in a case of receiving an impact transmitted from the platen holder to the receipt part via the attachment part, to be deformable due to a distance between the third position and the attachment part, so as to disperse the impact.

11. The printing apparatus according to claim 1, wherein the support member is configured to support a sensor, the sensor is configured to detect presence or absence of the printing medium conveyed by the platen roller.

12. The printing apparatus according to claim 11, wherein the support member includes:

the base part fixed to the opening/closing cover; and the receipt part to which the platen holder is attached and fixed, and wherein the receipt part includes a first receipt part and a second receipt part provided with the sensor being interposed therebetween.

13. The printing apparatus according to claim 1, wherein the opening/closing cover has a notch, and wherein the platen roller extends in a first direction and is disposed within the notch in the first direction, the first direction being parallel to the shaft center direction of the platen roller.

14. The printing apparatus according to claim 13, wherein both end portions of the platen roller are located on an inner side of the notch in the first direction.

15. A printing apparatus comprising:

a print head configured to perform printing on a printing medium;

a main body having an accommodation part accommodating the printing medium;

an opening/closing cover supported by the main body so as to be swingable between a closed position and an opened position, the opening/closing cover covering the accommodation part in a case the opening/closing cover is in the closed position, the opening/closing cover opening the accommodation part in a case the opening/closing cover is in the opened position;

a support member provided to the opening/closing cover; and a platen holder provided to the support member and configured to rotatably support a platen roller, the platen roller being configured to convey the printing medium at a position facing the print head in the case the opening/closing cover is in the closed position, wherein the opening/closing cover is pivotally supported by the main body so as to be swingable by a support shaft, wherein the support member includes:

a base part fixed to the opening/closing cover, and a receipt part to which the platen holder is attached and fixed, wherein the receipt part is provided in a position more distant from the support shaft than the base part, wherein the platen holder includes an attachment part attached and fixed to the receipt part of the support member, wherein the platen holder is configured to support the platen roller at a position more distant from the support shaft than the attachment part, wherein the base part is provided on a respective side of the support member in a first direction, the first direction being parallel to a shaft center direction of the platen roller, wherein each position of the base part on the respective side in the first direction is located on a more outer side in the first direction than a respective position of an end portion of the platen roller in the first direction, wherein the attachment part is provided on a respective side of the platen holder in the first direction, and wherein each position of the attachment part on the respective side in the first direction is located on a more inner side in the first direction than the respective position of the end portion of the platen roller in the first direction.

* * * * *